United States Patent [19]

Hyre

[11] 4,279,088

[45] Jul. 21, 1981

[54] VISUAL STIMULATION APPARATUS USEFUL IN THERAPEUTIC TREATMENT

[76] Inventor: Robert W. Hyre, 4056 Brookfield Cir., Chattanooga, Tenn. 37412

[21] Appl. No.: 94,673

[22] Filed: Nov. 15, 1979

[51] Int. Cl.[3] ..... G09F 13/04

[52] U.S. Cl. ..... 40/442; 40/902

[58] Field of Search ..... 40/442, 443, 219, 902; 352/100

[56] References Cited

U.S. PATENT DOCUMENTS

| | | | |
|---|---|---|---|
| 1,520,729 | 12/1924 | Stoewsand | 40/442 |
| 2,020,087 | 11/1935 | Treshansky et al. | 40/442 |
| 2,812,607 | 11/1957 | Briggs | 40/443 X |
| 3,060,795 | 10/1962 | Corrigan et al. | 352/131 |
| 3,745,678 | 7/1973 | Thomassen | 40/442 |
| 3,951,529 | 4/1976 | Gandia | 352/100 |

FOREIGN PATENT DOCUMENTS

| | | | |
|---|---|---|---|
| 457920 | 3/1928 | Fed. Rep. of Germany | 40/442 |

OTHER PUBLICATIONS

A. C. Williams, "Perception of Subliminal Visual Stimuli", Journal of Psychology, vol. 6, 10–1938, pp. 190, 191, 196, 197.

*Primary Examiner*—John F. Pitrelli
*Attorney, Agent, or Firm*—Laurence R. Brown

[57] ABSTRACT

There is provided a visual stimulation instrument operable to induce by perception of a visual message useful in therapeutic treatment of psychological and psychic disorders. A simple embodiment provides messages viewed by a patient with a sheet of paper comprising a viewing screen, with a lamp behind the paper flashed at high intensity during very short periodic intervals. One embodiment has two successive sheets of paper, one with an overt message and another with a covert message in such contrast that the lamp flash does not permit recognition of the covert message but does cause a conscious recognition of the overt message through the afterglow mechanism of the eye. The flashing by a gaseous discharge lamp preferably occurs periodically at a rate in the order of one to three seconds between flashes.

5 Claims, 2 Drawing Figures

FIG. 1
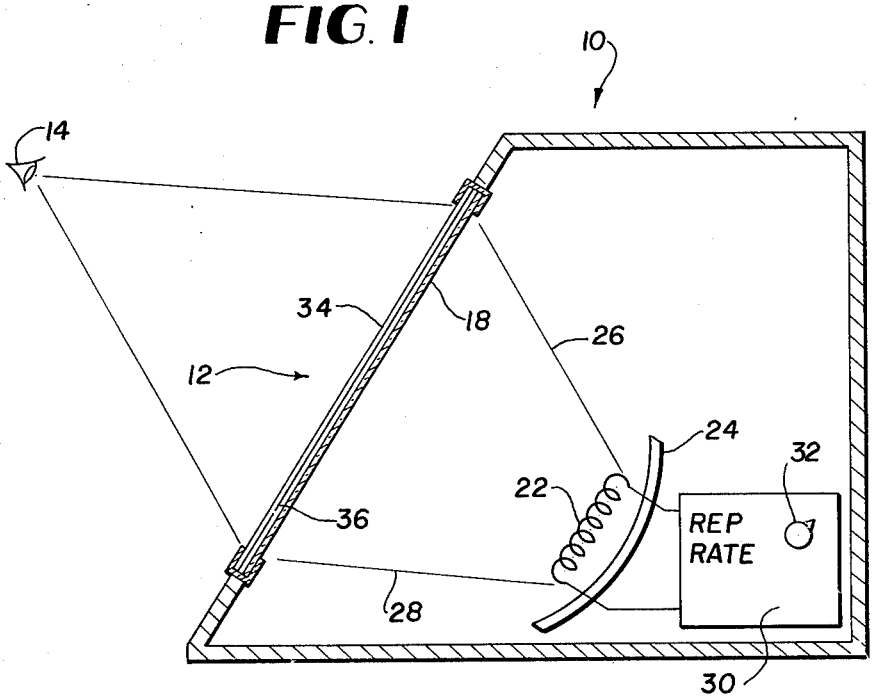
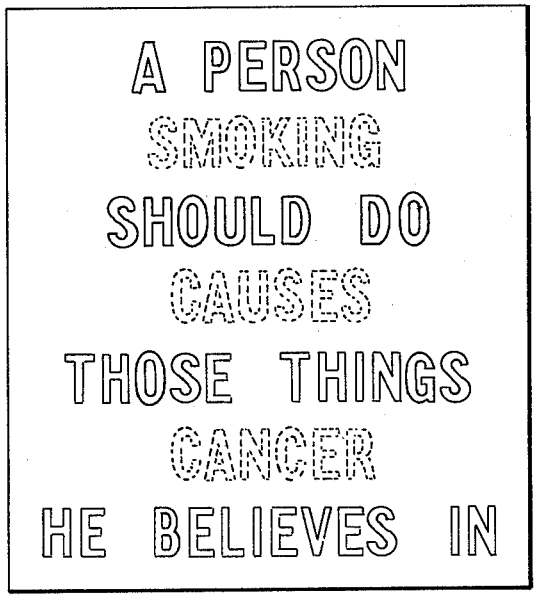
FIG. 2

VISUAL STIMULATION APPARATUS USEFUL IN THERAPEUTIC TREATMENT

TECHNICAL FIELD

This invention relates to instrumentation useful in therapeutic treatment of psychological and psychic disorders and more particularly it relates to visual stimulation equipment for inducing covert information into the patient's memory system which is deemed by the patient to be self derived.

BACKGROUND ART

Difficulties arise in therapeutic treatment of psychological and psychic disorders because patients close their minds and are not receptive to reasonable suggestions of a therapist for inducing learning or behavioral changes. Most patients will place a higher value on concepts self derived from their own analysis than those not based on personal experience and those strange or contrary to self determined behavioral patterns. It is therefore a problem for therapists to convert a patients's behavioral pattern by direct counsel, advice or persuasion.

It has long been known, as evidenced by U.S. Pat. No. 3,060,795-Oct. 30, 1962, R. E. Corrigan et al., and an article entitled "Perception of Subliminal Visual Stimuli" by A. C. Williams in Journal of Psychology, Vol. 6, July-Oct., 1938, for example, that indirect visual stimulation can reach through such mental blocks. However, the techniques of that patent involving subliminal perception rely upon an obscure and vague image that is difficult to perceive by many minds and patients. That teaching is limited to producing a covert message with an effective intensity barely perceivable and below that ability or conscious recognition level of an observer to report the stimulus verbally. Thus, the message is presented in an environment where the observer is not consciously aware of any change in his environment and physical status when the input information is imparted.

This is an additional deficiency in the treatment of psychological or psychic disorders because it is rarely possible to significantly improve behavior patterns unless the patient is willing to accept treatment from the therapist by self determination and has an interest in the correction of a problem.

Thus a departure from those prior art teachings is necessary both for obtaining a more prominent, intense and effective stimulus and for treating patients under environmental conditions where they are willing to look for solution to a problem.

It is therefore an object of this invention to provide more effective equipment for visual stimulation of a character useful for therapeutic treatment of psychological and psychic disorders.

BRIEF DISCLOSURE OF THE INVENTION

Therefore in accordance with this invention a covert message is placed in the environment of an overt message in such a way it can be subliminally displayed. Thus the message may be implanted into the observer's subconscious mind so that it will later materialize in a more acceptable form for inciting the observer's action and interest, namely as an apparent self derived observation from the observer's own recall and thinking process.

For therapeutic treatment of psychological and psychic disorders the message is made more effective and more forceful with more prominent reinforcement than feasible heretofore by a mode of operation in which the observer wants to be treated and is receptive to solution of a problem. Therefore, the patient knows he is undergoing treatment but is not conscious of the exact message which is being subliminally displayed or the nature of the treatment.

In this environment therefore a message is flashed periodically at an intensity so high that it overloads the observer's eye mechanism leaving an afterglow in the persistence medium much as occurs when a photo flash lamp is observed. The observer has only the message before him as by observation in a dark room. In this invention such a flashed message is readable by the observer but it is modulated by a covert message to thereby effectuate a stronger stimulus of a specific covert message than heretofore feasible with less intense messages applied in more detracting surroundings. The flash lamp or equivalent energy source for this visual stimulus mode is periodically triggered at a rate in the order of about one to three seconds between flashes to reinforce the conscious and subconscious images so formed thereby to induce an implanted message quickly and completely in the memory banks of the observer for his later recall as a new and refreshing thought derived by his own thinking, analysis and discovery.

A simple instrument for carrying out the teachings of this invention comprises a viewing plane for holding a written or printed message in viewing position. This could be simply a glass plate for receiving one or two paper sheets. The paper which is partially opaque is made translucent when passing the high intensity light photo flash therethrough, thus permitting an overt message on the face or back of the paper sheet to be viewed and read by the observer. Then a second covert message on a second paper sheet or the back of a first in less prominent contrast also is presented in subliminal form by flashing the light source of high intensity such as a gaseous discharge tube. The high intensity flash is much shorter than the persistence period of the eye mechanism being a small fraction of a second, and therefore with the lesser contrast of the covert message does not permit the viewer to consciously read the covert message. However, possibly because of the high intensity causing the afterglow effect, the covert message is available in the eye mechanism for inciting the brain channels which stores the message for later recall, and very effectively implants the message for later use by the observer.

This leads to the introduction of behavioral modification suggestions in therapeutic treatment that would be otherwise rejected and contested if directly introduced by the therapist and converts the message by subliminal implantation into a suggestion more readily followed by a patient who deems it to be by his own reasoning.

BRIEF DESCRIPTION OF THE DRAWINGS

Other objects, features and advantages of the invention will be found throughout the following more detailed description which refers to the accompanying drawing, wherein:

FIG. 1 is a section right elevation view of visual stimulation equipment provided by this invention comprising a cabinet showing internally therein block and schematic representations of lighting means for displaying the aforementioned overt and covert messages, and FIG. 2 represents a typical message display as used in accordance with this invention with the FIG. 1 embodiment.

DETAILED DESCRIPTION OF A PREFERRED SIMPLIFIED EMBODIMENT OF THE INVENTION

As may be seen in FIG. 1, a cabinet 10 presents a viewing plane 12 visible to the eye 14 of an observer. Preferably the observer is in a dimly lighted or darkened room so that his pupil openings are enlarged, and there are no auxiliary targets for attention.

A gaseous discharge lamp 22 is arranged to pass a high intensity light through the viewing opening toward the eye 14 of the observer, as aided by the focus lens 24. This is diagrammatically illustrated by rays 26, 28.

The discharge lamp assembly has a power supply and firing mechanism 30, shown in block form, with a repetition rate adjustment 32 which permits flashes at an exemplary periodic rate of from one to three seconds per flash. This assembly may be the commercially available type known as "Luna Lite" model ST-F available from IMS Corp., Albuquerque, N. Mex: 87110, or constructed similar to that shown in U.S. Pat. No. 4,042,919-R. L. Patty issued Aug. 16, 1977. In the latter instance a single push button permits individual flashes at an asynchronous rate, if desired.

The message to be viewed may be, for example, on two sheets of white translucent paper 34, 36 with sheet 34 having an overt message foremost and sheet 36 having the covert message rearmost, with glass plate 18 being a resting platform. The paper essentially provides a viewing screen. Any equivalent form of message presentation can be used.

As shown by FIG. 2 with the two messages superposed as seen from 14, the overt message on sheet 34 is shown in full text and the covert message on sheet 36 is shown in phantom line. Preferably the messages do not interfere or overlap and thus printed text is a simple and effective medium. However, the techniques of this invention can be expanded to the whole range of instrumentation as typified in the above-mentioned U.S. Pat. No. 3,060,795 for example to include pictures, television, movie displays, and the like, without departing from the spirit or scope of this invention. For the purposes intended the disclosed embodiment is preferred as a simple inexpensive and effective instrument that can be adapted to treatment of a wide range of psychological and psychic problems.

In viewing the message the typical overt message "A person should do those things he believes in" is chosen to frame the patient's attitude into a receptive rather than hostile mood, so that physiological and psychic mental blocks will not be interposed in receiving the covert message.

It is assumed as a typical example that the patient wants to quit smoking and agrees to therapeutic treatment for that problem. If a person has not been able to break the habit it may also be assumed that there would be a hostile or psychological block toward receiving a direct suggestion from the therapist until the receptiveness for that suggestion was established.

If it is assumed the subliminal message "smoking causes cancer" were implanted then a logical course of action for the therapist would be to ask the patient "What reasons do you have for motivating you to quit smoking?" Then it would appear to the patient that he would be following his own suggested plan of action by thinking out that "smoking injures my body by causing cancer", thus motivating him to an effort to quit. Many other types of such problems can be handled by such simple equipment and messages as displayed here.

The simple display mechanism illustrated depends upon the translucence of the paper, which can simply be written, printed or lettered with an opaque black ink from a liquid crayon type marker, for example, to form the desired message. The covert message may be given more relative contrast by using pencilled lettering, for example.

Then when gas tube 22 is discharged for a tiny fraction of a second, the eye 14 will experience an afterglow where the overt message on front sheet 34 is made clearly visible to the observer by the afterglow retentivity of the eye mechanism. Thus, the eye will be able to consciously read or recognize the overt message on sheet 34 even with the short exposure display time of the message.

The intensity is so high, particularly in a darkened room with larger pupil openings, that there is a conscious knowledge and perception of the flashing of the gaseous discharge lamp 22 and the knowledge that this somehow aids the therapeutic treatment of a problem. Also the entire attention is directed to the screen 12 since in a blackened room there is no other interfering message.

Perhaps hypnosis effect may even play an effect in the positive results obtained from this form of therapeutic treatment since it becomes quite effective when a repetition rate of one to three seconds per flash is sustained for a few minutes of treatment. In any event, it is clear that the intensity and repetition frequency of this method and apparatus serves to reinforce a subliminal message very quickly so that it will be recalled by the observer without consciously remembering the message that was implanted.

It is also more effective to provide the messages as shown in non-interfering non-overlapping but superimposed form in a viewing field large enough that the eye does not focus on a limited focal point. When the viewer observes the viewing plane therefore the overt message seems displayed as accented by a flashing strobe light from time to time without making the covert message consciously recognizable to the viewer.

It has also been discovered in connection with this invention that the use of this instrument with only the overt message as displayed in FIG. 2, in the manner described, will effectively reach the subconscious mind of the viewer to cause a change in behavior of the viewer.

Thus, for example, a person who has not been successful in stopping smoking by means of other inducements, will upon viewing a message such as "smoking is injurious to the health" as a single overt message by this means and apparatus will be able to quit smoking by his or her own conviction as if the thought were derived in the person's own mind by means of subconscious inducement.

Accordingly, because of some unexplainable effect such as possibly hypnotic or subliminal suggestion, the use of this apparatus in treating psychic or psychological behavior is more effective than a corresponding attempt to relay the same visual message by other means than the periodic flashing of the message in an environment requiring concentration and visibility of only that flashing message of such intensity as to produce an afterglow effect in a blackened room where only the message is visible to the person being treated when the apparatus is flashed at a critical rate in the order of about two seconds per flash.

Having therefore introduced an improved and more effective instrument operating in a different mode to visually stimulate an observer by subliminal messages in such a manner to aid therapeutic treatment, those features of novelty believed descriptive of the spirit and nature of the invention are set forth in the claims.

INDUSTRIAL APPLICATION

A simple, inexpensive instrument is afforded for implanting messages into the subconscious mind by visual perception in such a way to afford therapeutic treatment of psychological or psychic disorders.

I claim:

1. Visual stimulation apparatus useful for therapeutic treatment of psychological and psychic disorders by inducing information in a patient's memory system which is deemed by the patient to be self derived, comprising in combination, display means presenting a visual message at a viewing plane consciously visible to a viewer by an afterglow mechanism of the eye with a message content acceptable to the viewer, and means displaying the message to the viewer making it visible only with light flashes of a duration and repetition rate insufficient in view of the persistance of the eye to cause said message to persist and with sufficient intensity to cause the message to leave a perceptible afterglow image in the viewer's eye mechanism and of short enough duration and contrast that the context of the visual message affects the subconscious mind of the viewer but is visible consciously only by the afterglow phenomenon, wherein the visual message comprises an overt and a covert portion both of a motionless printed message type, wherein the covert portion is not consciously visible to the viewer in said afterglow, wherein the first overt message is displayed at said plane upon a partially opaque surface such as paper that is made transparent by a bright light directed therethrough, said second covert message is displayed on a second surface behind said opaque surface, and the means including the light displaying the messages flashes a lamp at a high intensity to display the overt message at highly visible intensity at said viewing plane, and wherein the covert message is on a similar partially opaque surface such as paper, and including means lighting the viewing surface of the first message at said viewing plane sufficiently to comfortably view the message displayed thereon without displaying the covert message.

2. Apparatus as defined in claim 1 wherein said light is periodically flashed to display the overt message at a repetition rate in the order of one flash each two seconds.

3. Apparatus as defined in claim 1 with means reducing the light level about the viewer to thereby cause viewing at the messages with full attention and large pupil openings.

4. Apparatus as defined in claim 1 wherein the second covert message has a display area within the context of the first visual overt message large enough to avoid focal attention by the observer on the covert message.

5. Apparatus as defined in claim 1 wherein said means displaying the messages comprises a photo flash type lamp system with a gaseous discharge tube.

* * * * *